US005180358A

United States Patent [19]

Pace

[11] Patent Number: 5,180,358

[45] Date of Patent: Jan. 19, 1993

[54] ADJUSTMENT MECHANISM FOR LOW SPEED PARTICLE CONCENTRATOR

[75] Inventor: Dan R. Pace, Halifax, Canada

[73] Assignee: Occam Marine Technologies, Ltd., Halifax, Canada

[21] Appl. No.: 762,029

[22] PCT Filed: Jan. 24, 1991

[86] PCT No.: PCT/CA91/00019

§ 371 Date: Sep. 17, 1991

§ 102(e) Date: Sep. 17, 1991

[87] PCT Pub. No.: WO91/11263

PCT Pub. Date: Aug. 8, 1991

[30] Foreign Application Priority Data

Jan. 24, 1990 [CA] Canada ..... 2008493

[51] Int. Cl.[5] ..... B04B 1/10; B04B 1/14

[52] U.S. Cl. ..... 494/48; 494/84

[58] Field of Search ..... 494/48, 44, 46, 47, 494/56, 61, 67, 68, 84, 85, 83, 900; 210/781

[56] References Cited

U.S. PATENT DOCUMENTS 1,381,330 6/1921 Pechstein .
1,395,517 11/1921 Peck .
1,613,579 1/1927 Hinchley et al. .
4,083,488 4/1978 Gunnewig ..... 494/48
4,113,172 9/1978 Pautsch ..... 494/48

*Primary Examiner*—Robert W. Jenkins
*Attorney, Agent, or Firm*—Jones, Tullar & Cooper

[57] ABSTRACT

Adjustment mechanisms for a low speed decanting centrifuge (10) for separating relatively large particulate material (e.g. yeast) from a feedstock are disclosed. The centrifuge is clamped to a container (12) and the centrifuge housing (18) is pressurized to, in turn, pressurize the container and force feedstock upwardly into the lower bowl (116) of the centrifuge. A stack of inverted frustoconical discs (278, 280, 282) carry supernatant downwardly and inwardly for vertical transfer to a discharge chamber (76). Particulate matter is centrifugally discharged continuously between engageable surfaces (146, 148) of the lower bowl member (116) and the upper bowl member (140). The invention provides for automatic or manual adjustment of the maximum gap available between the bowl members during operation. In one embodiment the drive motor (422), transfer tube (454), upper bowl members (470) and disc stack (482) are connected together so that the assembly thereof can be vertically adjusted through a gear train (434 to 444). In another embodiment an adjusting nut (512) on the transfer shaft (506) is used to determine the upper limit of the upper bowl member (502). A gear train (516, 536, 540) is used to move the adjusting nut on the transfer tube (506). In each case adjustment can be effected while the centrifuge is running.

16 Claims, 11 Drawing Sheets

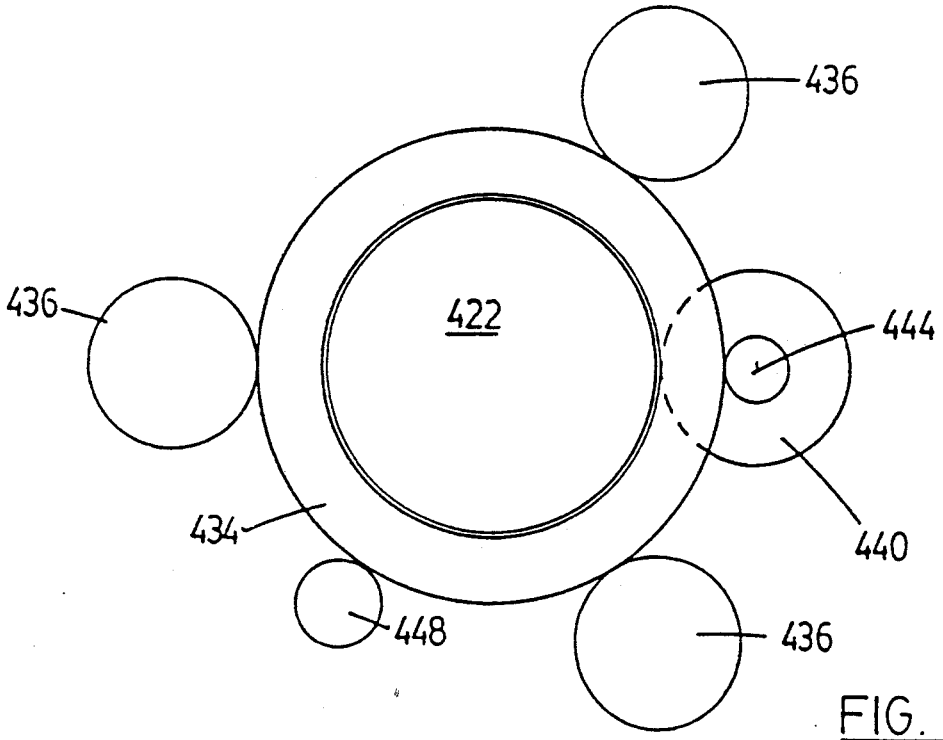
FIG. 14
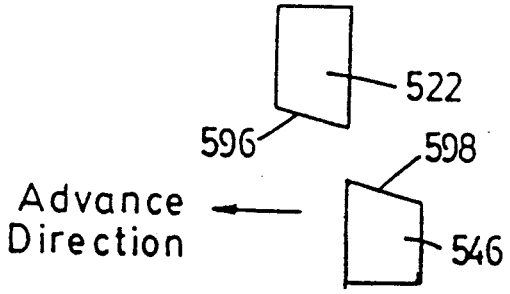
FIG. 15
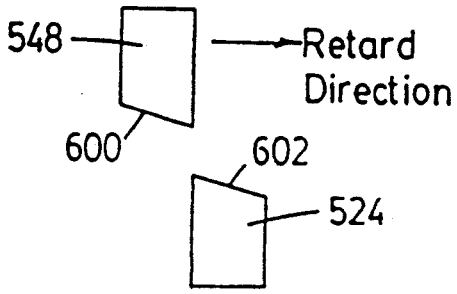

ADJUSTMENT MECHANISM FOR LOW SPEED PARTICLE CONCENTRATOR

TECHNICAL FIELD

The present invention relates in general to a compact, inexpensive low speed centrifuge primarily useful to microbiologists. In particular it relates to improvements in adjusting and controlling the operation of such centrifuges.

BACKGROUND ART

When attempting to separate particulate matter from a fluid, it is known that very small (slowly settling) particles are exponentially more difficult to separate by centrifugation than larger particles. Accordingly, most disc-type centrifuges are designed to spin at extremely high speeds in order to separate the smallest particles at a reasonable rate. High speeds mean high stress on the equipment and on the particulate matter being separated. On the other hand, it is not always necessary for a centrifuge to be capable of separating extremely small particulate matter, especially if the operator is only interested in larger material.

However, there has not been any consideration given in the past to a disc-type centrifuge dedicated to larger particle separation such that the centrifuge could operate at relatively low speeds, resulting in less stress on the equipment and permitting the utilization of less exotic construction material and techniques.

Commonly assigned Canadian patent application Ser. No. 579,008 filed Sep. 30, 1988 discloses and claims a low speed particle concentrator or centrifuge which overcomes the above-enumerated problems. That device includes as a feature thereof a mechanism for controlling the particulate outflow by controlling or adjusting the operating gap between the upper and lower bowls thereof. Adjustment is effected manually, by rotating an adjusting nut relative to the upper bowl member, the nut defining or setting an upper limit to the available upwards movement of the upper bowl member. The mechanical adjustment must be effected while the concentrator is at rest.

There are instances and circumstances which necessitate, or at least make it desirable, to have automatic or powered adjustment of the inter-bowl gap available. For example it may be desirable to have the gap increase automatically at preset intervals of time to flush out oversized particles, or to change back and forth between different gap settings for culture mode and separation mode as in semi-continuous culture. Also, after the device has been stopped completely the impeller pump must be re-primed, further complicating the procedure for automated adjustment.

DISCLOSURE OF INVENTION

The present invention provides certain improvements over the concentrator or centrifuge of the aforementioned Canadian patent application No. 579,008. In particular the present invention provides means for achieving automatic control or movement of the upper bowl member to control thereby the gap between the upper and lower bowl members. Such control may be the result of input from an operator who, through appropriate equipment, can raise or lower a limit setting element within the centrifuge while it is running, following a preset programme or in response to his observations and his knowledge of the consequences thereof. Alternatively the limit setting element could be computer controlled to follow a preset programme of movement or to respond to sensor inputs as part of a feedback circuit.

In one embodiment the drive motor is fixedly connected to the upper bowl member but is adjustably and resiliently mounted on the centrifuge housing so that it can be set at an appropriate maximum elevation as desired. The motor and the upper bowl member are biased towards a closure position with the lower bowl member but during operation the upper bowl member (and the motor) will lift when there is sufficient pressure in the centrifuge chamber. The maximum lift height is controlled externally of the housing by controlling, through a set of gears, the maximum height of the motor.

In the second embodiment the upper bowl is resiliently biased relative to an adjusting nut as in the earlier application referred to herein. In this case appropriate gear means are carried by the adjusting nut and are provided within and without the housing so that the nut can be raised or lowered at will to thereby control the maximum gap attainable between the upper and lower bowl members.

Generally speaking, therefore, the present invention in a first embodiment thereof may be considered as providing in a centrifugal particle concentrator having: a housing mountable on a container; upper and lower rotatable bowl members within the housing, the upper bowl member being vertically movable relative to the lower bowl member; rotatable separator means within the bowl members; and a transfer tube extending axially of the concentrator, mounting the upper bowl member and the separator means at one end thereof and being drivingly connected to a drive motor at the other end, the transfer tube having a bore extending longitudinally thereof and communicating the separator means with a discharge chamber of the housing; the improvement in means for adjustably establishing a maximum available gap between the bowl members during operation of the concentrator, comprising: an annular sun gear extending circumferentially about the drive motor; a plurality of planetary gears engaging the sun gear and spaced circumferentially thereabout, each planetary gear being threadedly engaged with a non-rotatable mounting screw extending parallel to the transfer tube and being anchored in a boss affixed to the housing; mounting means secured to the drive motor and extending radially outwardly therefrom, the mounting means being slidably receivable on each mounting screw between the respective planetary gear and boss, there being a first compression spring on each screw between the mounting means and planetary gear and a second compression spring on each screw between the mounting means and boss; and an adjustment motor on the housing, drivingly connected to an adjustment gear engaging the sun gear; whereby rotation of the adjustment gear will cause rotation of the sun gear and consequent rotation of the planetary gears, such rotation of the planetary gears causing movement of each planetary gear along its mounting screw to further compress or to relax the compression springs and thereby control the amount of vertical movement available to the drive motor, transfer tube, separator means and upper bowl member relative to the lower bowl member.

Also, in another embodiment, the present invention may be considered as providing in a centrifugal particle concentrator having: a housing mountable on a container; upper and lower rotatable bowl members within the housing, the upper bowl member being vertically movable relative to the lower bowl member; rotatable separator means within the bowl members; and a transfer tube extending axially of the concentrator, slidably mounting the upper bowl member and fixedly mounting the separator means at one end thereof and being drivingly connected to a drive motor at the other end, the transfer tube having a bore extending longitudinally thereof and communicating the separator means with a discharge chamber of the housing; the improvement in means for adjustably establishing a maximum available gap between the bowl members during operation of the concentrator, comprising: an adjusting nut threadedly mounted on the transfer tube above the upper bowl members, with a plurality of circumferentially spaced compression springs between the upper bowl member and the adjusting nut; a primary gear cluster rotatably mounted on the adjusting nut, the gear cluster including a greater adjusting gear thereon spaced therealong from a lesser adjusting gear thereon; bi-directional overrunning clutch means drivingly connecting the primary gear cluster to the adjusting nut; a plurality of secondary gear clusters spaced circumferentially about the transfer tube, each secondary gear cluster including a transfer drive gear at one end thereof, spaced therealong from a lesser transfer gear and an adjacent greater transfer gear; a drive gear slidably and drivingly mounted on the transfer tube drivingly engaging each transfer drive gear; a transfer shaft for each secondary gear cluster, extending parallel to the transfer tube and rotatably mounting the respective secondary gear cluster thereon; and means for raising and lowering the transfer shafts in synchronism; whereby, as the transfer tube rotates the drive gear will cause each the secondary gear cluster to rotate on its transfer shaft, vertical movement of the transfer shafts from a neutral position thereof bringing either the greater or lesser transfer gears of the secondary gear clusters into driving engagement with the lesser or greater adjustment gear respectively of the primary gear cluster to either increase or decrease the rotational speed of the adjusting nut relative to the transfer tube so as to cause the adjusting nut to advance or retreat along the transfer tube and thereby increase or decrease the degree of compression in the springs to control the maximum available gap between the bowl members.

BRIEF DESCRIPTION OF THE DRAWINGS

FIG. 14 is a plan view showing the location of control gears and elements used in the embodiment of FIG. 13.

FIG. 15 shows the orientation of the various gears used in the embodiment of FIG. 16.

DESCRIPTION OF THE ESTABLISHED STRUCTURE

Figure 1A:
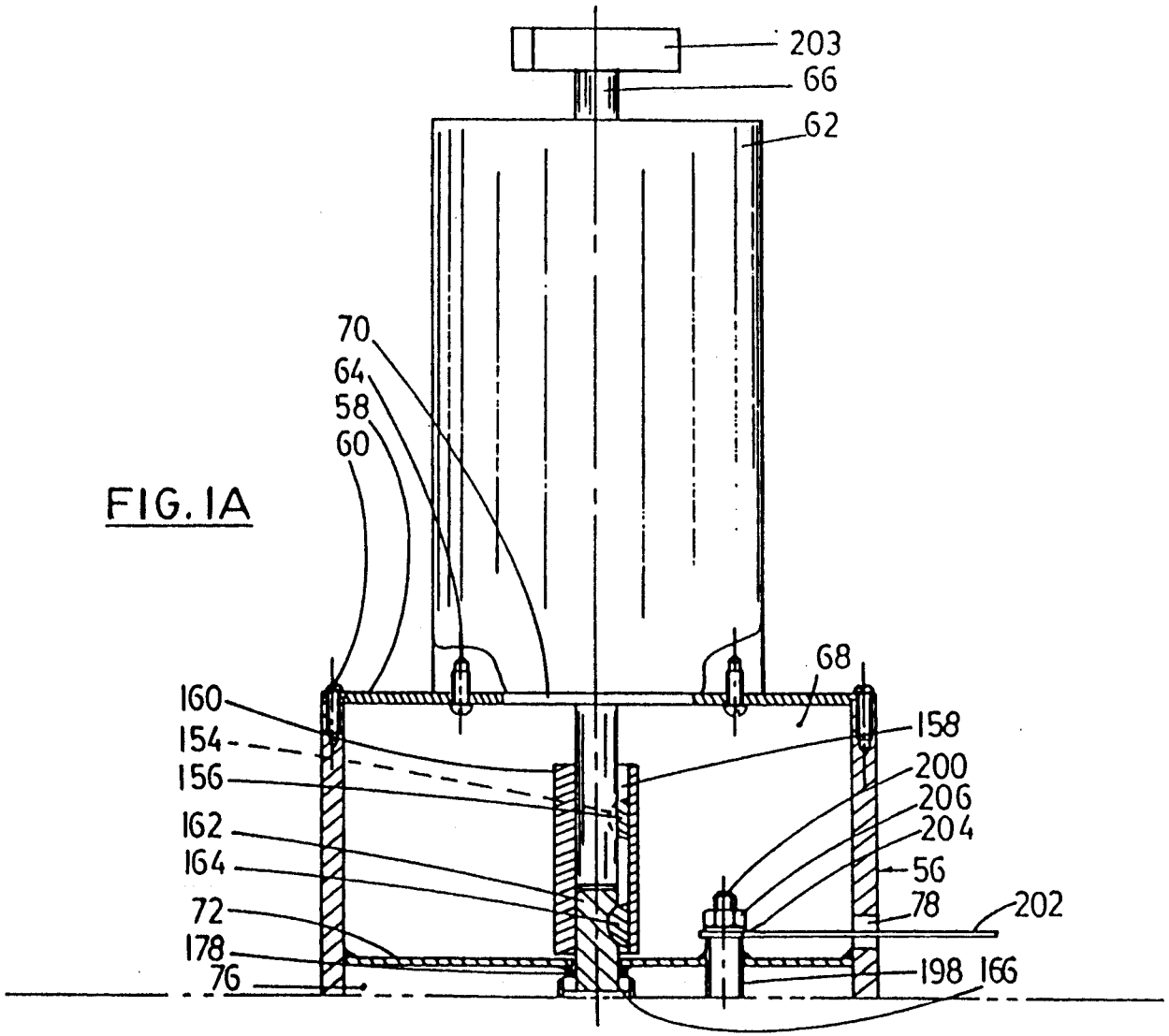
FIGS. 1A, 1B and 1C together show a vertical cross-section through the decanting centrifuge according to Canadian Ser. No. 579,008.
Figure 1B:
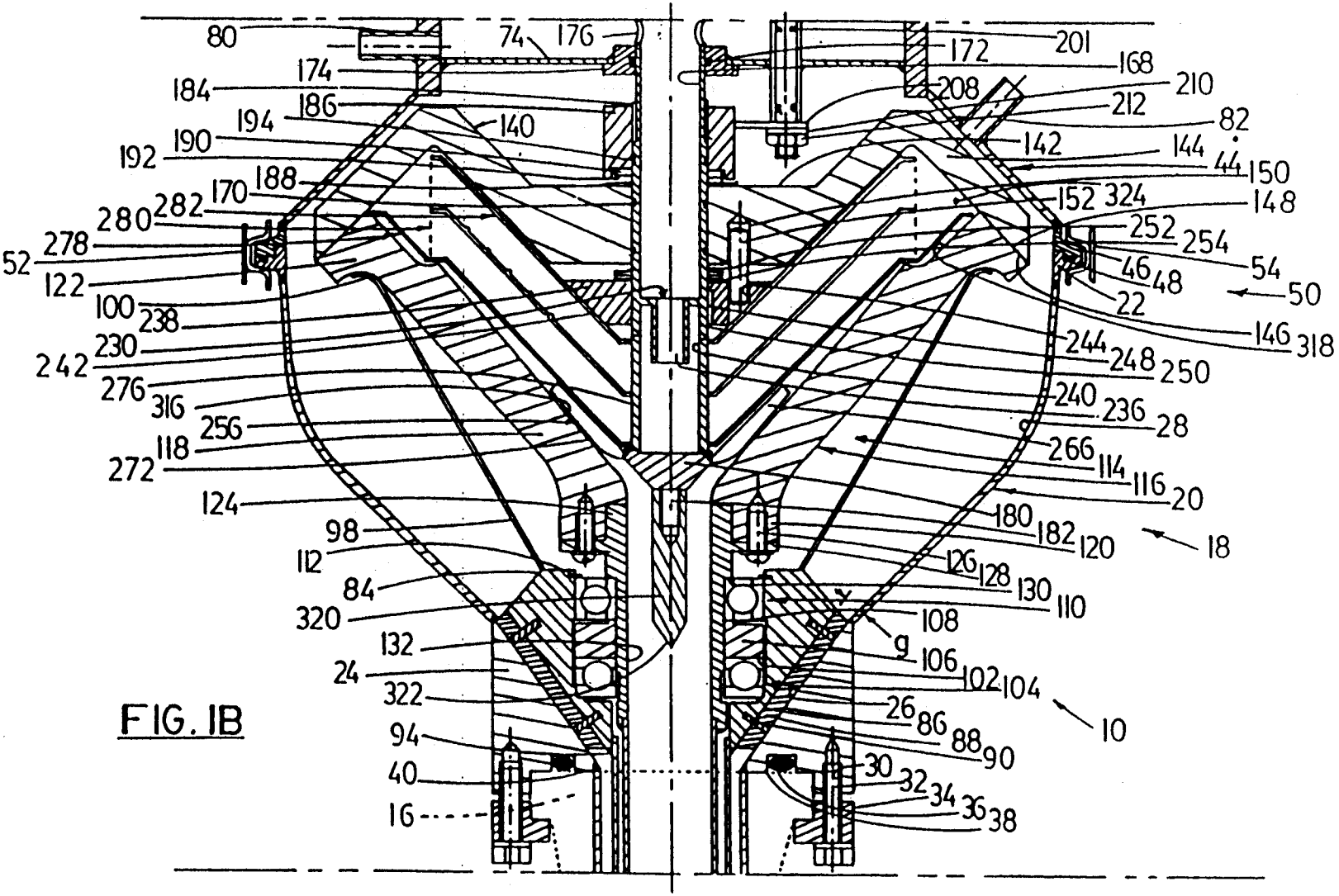
Figure 1C:
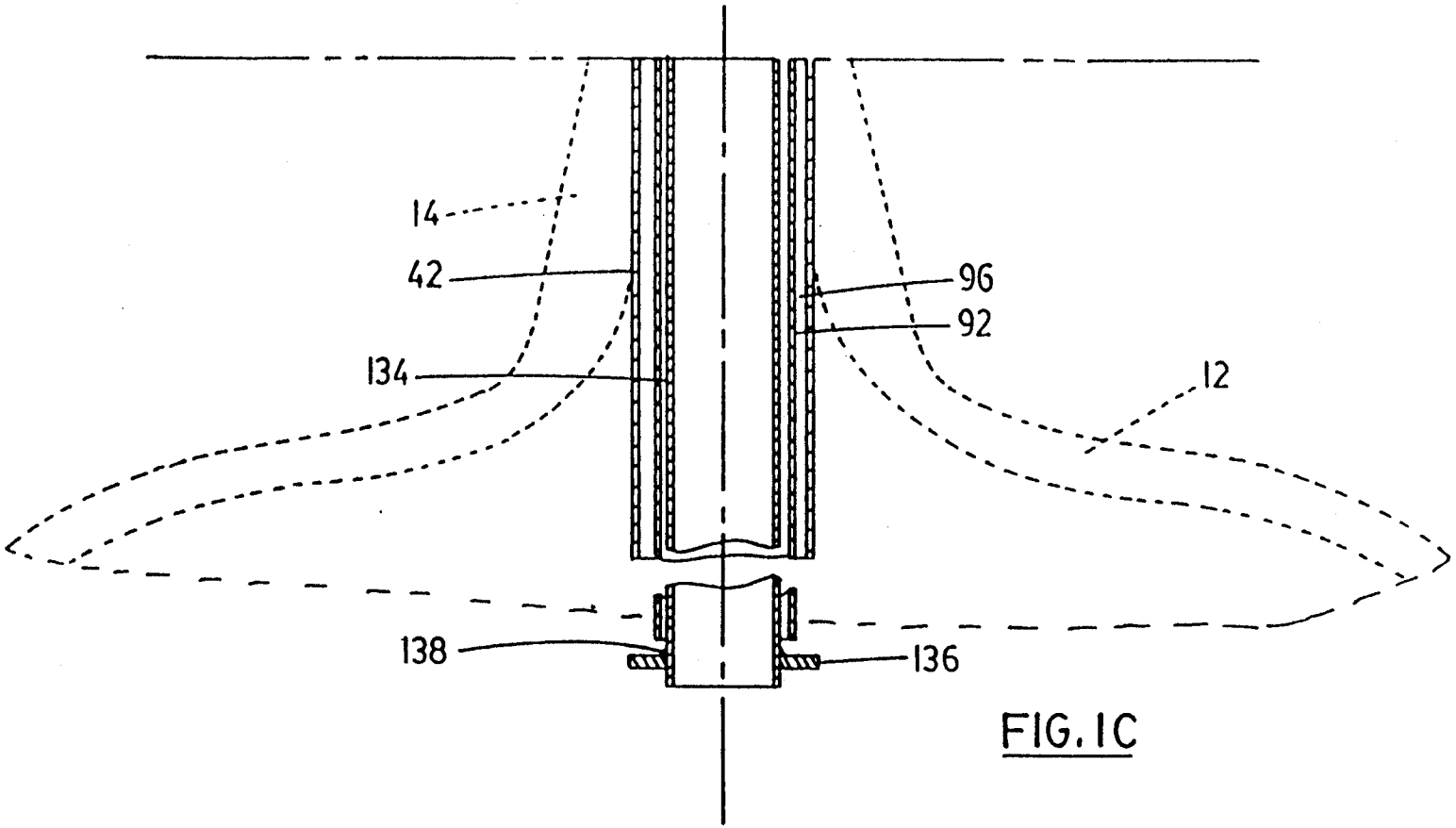

FIG. 1 illustrates in cross-section the major components of the decanting centrifuge according to Canadian Ser. No. 579,008. The centrifuge 10 is particularly designed for, but not restricted to, use with a container 12 having an upwardly-extending cylindrical neck 14 with a peripherally flanged rim 16 at the top thereof.

The centrifuge includes a housing 18 which is composed of a lower upwardly-opening bowl-like member 20 having an upper peripheral rim 22 and an annular lower mounting member 24 for attachment to the container 12. The mounting member is generally triangular in radial cross-section with the inner surface 26 thereof being generally an extension of the inner surface 28 of the lower housing member 20. A plurality of circumferentially spaced threaded bores 30 in the base of the mounting member 24 receive threaded bolts 32 which, in turn hold sections of an L-shaped retaining ring 34 against the underside of container rim 16 so as to clamp the housing to the container. An annular O-ring 36 is held in an annular recess or groove 38 in the base of the mounting member 24 to seal the mounting member to the container.

Welded to the inner circular edge 40 of the mounting member 24 is a downwardly depending outer cylindrical member 42 having an outer diameter approximately equal to the inner diameter of the container neck 14. With the lower housing clamped to the rim 16 the outer cylindrical member 42 will extend into the container. The member 42 could terminate just inside the container or, if deemed desirable, it could extend further into the container perhaps almost to the bottom thereof.

The housing 18 also includes an upper inwardly flaring frustoconical member 44 having a lower circumferential rim 46 which is shaped for an interlocking fit with upper rim 22 of the lower housing member 18. One or both of the rims 22, 46 is grooved so as to receive an O-ring 48 and an annular retainer 50 is provided to secure the housing members 18, 44 together. Retainer 50 includes an annular, generally V-shaped clamp 52 which is adapted to bear against both rims 22, 46 and an outer clamp 54, such as a hose clamp or similar device for applying a peripheral clamping force to the V-clamp 52. Such retaining structure as described herein is commercially available.

The upper circular portion of the member 44 has welded thereto a cylindrical casing 56 which in turn has a motor mounting plate 58 attached to the upper end thereof by way of circumferentially spaced machine screws 60. A D.C. motor 62 is attached to plate 58 via machine screws 64 and the drive shaft 66 thereof extends downwardly into an upper drive chamber 68 through a circular opening 70 in the plate 58.

Drive chamber 68 is defined between mounting plate 58 and a first dividing plate 72 which spans and is welded to the interior of the casing 56. A second dividing plate 74 below the first plate 72 spans and is welded to the interior of casing 56 and defines, with the first plate 72, a discharge chamber 76.

Casing 56 is provided with a horizontal slot 78 above plate 72, spanning a small arc, say about 15°, of the casing side. Also, a discharge outlet port 80 is provided in the casing wall, in communication with the discharge chamber 76. Finally, a gas inlet port 82 is provided in the upwardly sloping wall of the upper frustoconical member 44. The purpose of the slot 78 and the parts 80, 82 will become more readily apparent hereinafter.

The foregoing has generally described the exterior aspects of the particle concentrator of Ser. No. 579,008. The interior aspects will now be described.

Within the lower casing or mounting member 24 is an annular lower bearing support member 84 having a frustoconical lower surface 86 parallel to the surface 26 of the mounting member 24. Attached to the surface 86 is a plurality, at least three, of radially projecting, circumferentially spaced, narrow rectangular vanes 88 secured to the bearing support member 84 by way of pins 90. The vanes 88 rest on the surface 26 and serve to space the bearing support member 84 away from the mounting member 24, defining a gap G therebetween.

An intermediate cylindrical member 92 is welded to the bearing support member 84 as at 94 and extends downwardly within the outer cylindrical member 42 so as to define an annular space 96 therebetween. Like member 42, the cylindrical member 92 can descend a short distance so that it just enters the container or it can extend downwardly a greater distance, perhaps almost to the bottom of the container. Preferably the member 92 will enter the container at least as far as the member 42.

A metallic, frustoconical thin deflector member 98 flares upwardly and outwardly from the top of the bearing support 84 and has an outwardly extending peripheral lip 100 at the top edge thereof. The function of the deflector member 98 will be discussed in greater detail hereinafter.

The bearing support 84 includes a counterbore 102 which receives a lower thrust ball bearing assembly 104, an annular bearing spacer 106 an upper radial ball bearing assembly 110 and a retaining ring 112, the last-mentioned item engaging in a complementary groove in the wall of bore 102 and serving to hold the bearings and spacer in place. Spacer 106 has a raised inner annular shoulder 108 which engages the inner race of bearing assembly 110 and thus takes the load off the outer race of that bearing assembly. There is a slight clearance between the outer surface of the spacer 106 and the counterbore 102 and the upper and lower races of the thrust bearing 104 are dissimilar in outer and inner diameters to permit gas to flow through the bearing assembly and purge any fluid which might enter the assembly.

Lower bowl assembly 114 includes a frustoconical bowl member 116 having upwardly and outwardly flaring wall 118, a downwardly extending annular hub 120 and an outwardly extending peripheral rim 122. The hub 120 is machined to receive the upper end of a bearing housing 124 which is attached to the hub 120 by machine screws 126 passing through a circumferential flange 128 of the bearing housing 124. The housing 124 has an annular shoulder 130 which rests on the inner race of the upper bearing assembly 110 and a cylindrical bearing portion 132 which engages the inner race of the upper bearing assembly 110 and the upper race of the lower bearing assembly 104 and the spacer 106. The bearing portion 132 extends below the lower bearing assembly 104 and has welded thereto an inner cylindrical member 134 which extends into the container 12 to a level just above the bottom of the container 12. An annular deflector plate 136 may be removably attached to the bottom of the inner member 134, the plate having an upwardly curving fillet portion 138 for increased surface contact with the member 134 and to provide a smooth interface with the outer wall of the inner cylindrical member 134. The plate 136 may extend radially beyond the intermediate member 92 if the intermediate member extends to a level just above the plate 136.

Upper bowl member 140 is positioned above the lower bowl member 116 and has an inner annular portion 142 and an outer portion 144 which has a generally inverted V-shape in cross-section. The portion 144 has an outer annular surface 146 which is sealingly engageable with an upper annular surface 148 of the rim 122 of the lower bowl member 116. Preferably, the surfaces 146, 148 will be generally parallel to the outer, downwardly sloping wall of outer portion 144 although they could also be normal to the central axis A of the centrifuge. A bore 150 extends upwardly into the inner portion 142 of the upper bowl member 140, from the bottom surface thereof, and receives the upper portion of a cylindrical drive pin 152.

As indicated previously, drive shaft 66 extends downwardly from motor 62 into drive chamber 68. Shaft 66 has a keyway 154 which receives a woodruff key 156. That key engages a keyway 158 in a cylindrical drive coupling or motor alignment bushing 160, which bushing receives the shaft 66 therein. A cylindrical transfer shaft 162 has its upper end received in bushing 160, the shaft 162 being keyed to the bushing for rotation therewith by a woodruff key 164 which is bonded to the bushing 160, thereby permitting easy removal of the motor. Shaft 162 extends downwardly through the first dividing plate 72 and terminates at an enlarged annular shoulder defining an end cap 166.

Extending from the shaft 162 is a cylindrical transfer tube 168 which extends from below the first dividing plate 72 to below the central portion 142 of the upper bowl member 140. Two O-rings 170 seal the tube 168 to the upper bowl member 140 and a gas seal 172 seals the tube with respect to a bushing 174 welded to the second dividing plate 74. In the discharge chamber 76 the transfer tube is provided with a plurality of circumferentially spaced discharge openings 176. At the upper end of the tube 168 the annular cap 166 is welded thereto and a V-ring seal 178 is positioned between the cap 166 and the underside of the first dividing plate 72, seal 178 also surrounding the transfer shaft 162. At its lower end (opposite transfer shaft 162) the tube 168 is welded to a generally frustoconical head member 180 which, in turn has a threaded shank 182 projecting axially therefrom.

In the area between the dividing plate 74 and the upper bowl member 140 the tube 168 is externally threaded as at 184 and an internally threaded adjusting nut 186 is engaged therewith. A washer 188 rests on the upper bowl member 140 and a wave spring 190 is positioned between the washer 188 and a counterbore 192 in the bottom of the nut 186. Spring 190 applies a downwards bias on the upper bowl member 140 against the adjusting nut 186. An O-ring 194 seals the transfer tube 168 to the axial bore of the adjusting nut.

Figure 2:
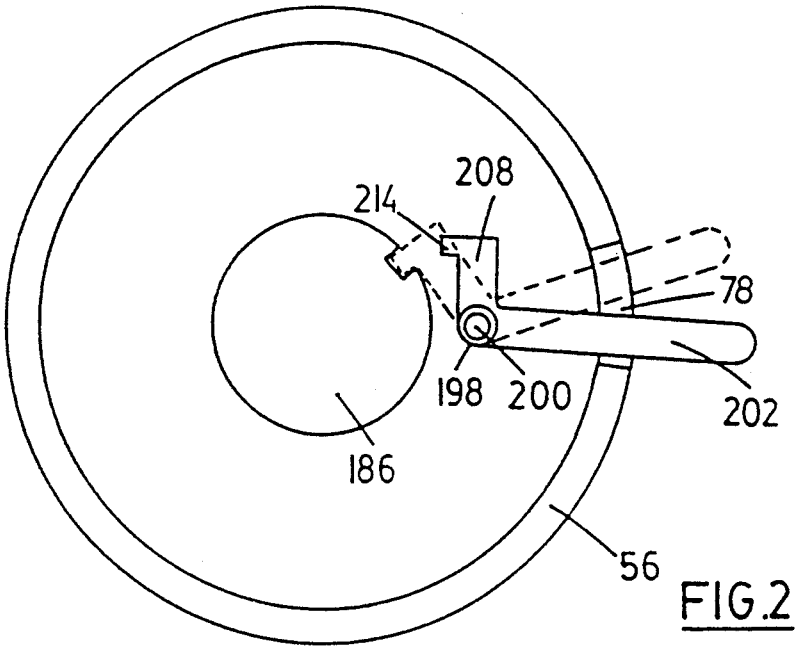
FIG. 2 illustrates in plan the operation of the adjusting nut used in the invention of Ser. No. 579,008.

As seen in FIG. 2, the adjusting nut 186 has a rectangular recess 196 in the upper side wall thereof.

Extending downwardly through the upper and lower dividing walls 72, 74 and welded thereto is a transfer tube 198. A transfer shaft 200, threaded at each end extends through the tube 198 with an O-ring 201 sealing the shaft with respect to the tube 198. A lever 202 is attached to the shaft 200 at the upper end thereof via washer 204 and nut 206, the lever being conventionally keyed to the shaft 200 and projecting radially of the shaft outwardly through the slot 78 in the casing 56 (see FIG. 2). At the lower end of the shaft 200 a locking lever 208 is keyed thereto and secured via washer 210 and nut 212. The lever 208 is angled relative to lever 202 and has a projection 214 at its free end. When the lever 202 is rotated from the solid line position of FIG. 2 to the dotted line position the projection 214 will be brought into engagement with the recess 196 in the adjusting nut 186 so as to prevent rotation of nut 186 while the tube 168 is rotated manually via the distal end of shaft 66. The relative rotation between tube 168 and nut 186 causes the nut to travel along the tube 168 thereby altering the gap between the nut and the upper bowl member and hence the degree of possible separation between the upper and lower bowl members. An adjustment wheel 203, may be provided above the motor 62 to effect the desired rotation of shaft 66 and tube 168. With the locking levers 202, 208 in the solid line position of FIG. 2 the nut 186 rotates along with the tube 168.

The structure within the upper and lower bowl members 140, 116 will now be described with reference to FIGS. 1 and 3 to 12.

Figure 3:
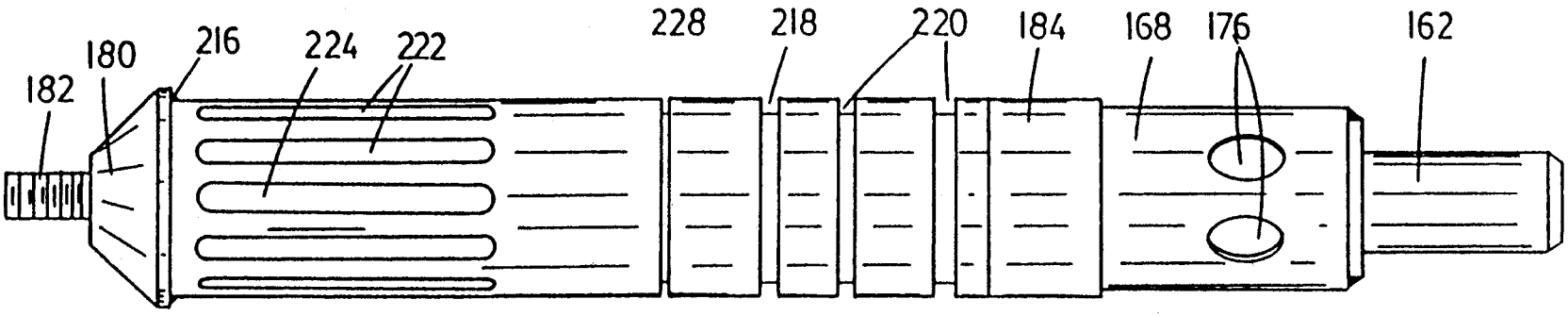
FIG. 3 shows the transfer tube of the centrifuge and FIG. 4 is a longitudinal section through the tube.
Figure 4:
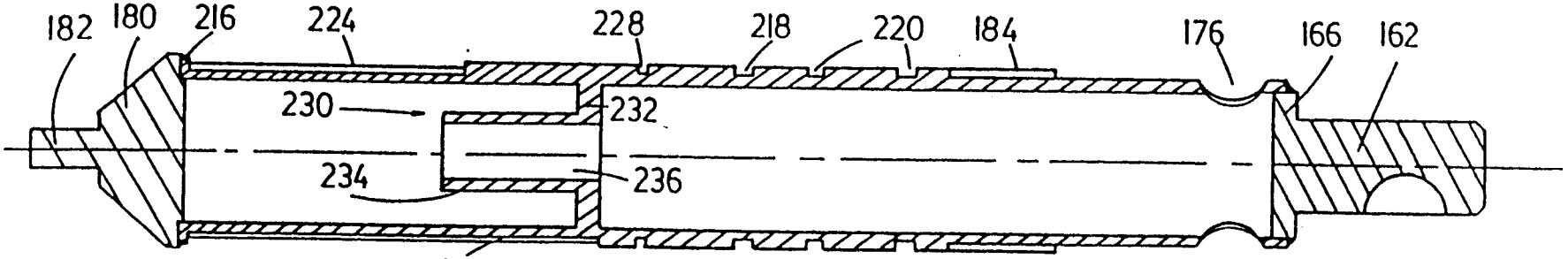

With particular reference first of all to FIGS. 3 and 4 further details of the transfer tube 168 will be described. It will be noted for example from FIG. 4 that the tube 168 is welded to the enlarged head 180 as at 216 so that the shaft 162, the head 180 and the transfer tube 168 will rotate together as the shaft 162 is rotated by the motor 62. Also shown in FIGS. 3 and 4 are the circumferential grooves 218, 218, 220 which receive the O-rings 170, 170, 194 respectively, the circumferentially spaced openings 176 and the external threads 184 to which the adjusting nut 186 is threaded.

At its lower end, closer to the head 180 the tube 168 is provided with a plurality of circumferentially spaced, axially extending, round ended slots 222, which slots are located circumferentially between a pair of diametrically opposed, axially extending keyways 224, 226. As seen best in FIG. 4 the keyway 226 is longer than the keyway 224, extending away from head 180 almost to a narrow circumferential groove 228.

Internally, the tube 168 is provided with an integral sill 230 which includes an annular internal flange 232 and an axially downwardly extending cylindrical tube 234 defining an axial passage 236. The purpose of the sill 230 will become apparent hereinafter.

With reference again to FIG. 1 there will be seen an upper disc support member 238 having a through bore 240 receiving the tube 168 and an outer downwardly and inwardly sloping surface 242. An axially extending counterbore 244 receives the drive pin 152, which pin is also received in the counterbore 150 in the upper bowl member 140 such that the members 140, 238 can rotate together. Furthermore, the member 238 has an axially extending keyway 248 in the bore 240 such that a key 250 is receivable therein as well as in the keyway 226, thereby keying the member 238 to the transfer tube 168.

Above the disc support member 238 a circlip or retainer ring 252, received in groove 228 of transfer tube 168 holds a wave spring 254 against the upper surface of the disc support member 238. The spring 254 applies a downwards bias against the disc support member 238.

Figure 5:
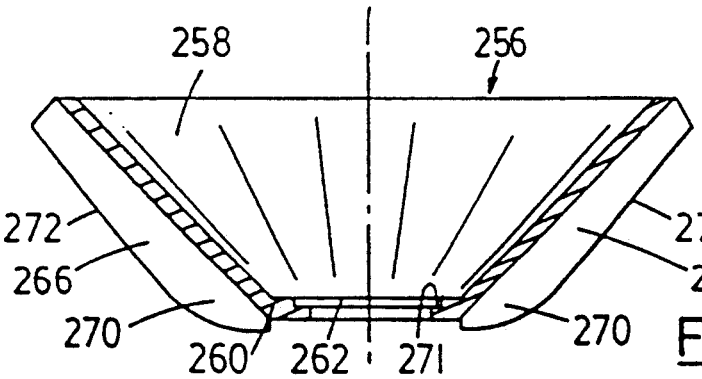
FIGS. 5 and 6 show a longitudinal section and a plan view of the lower disc support of the centrifuge.
Figure 6:
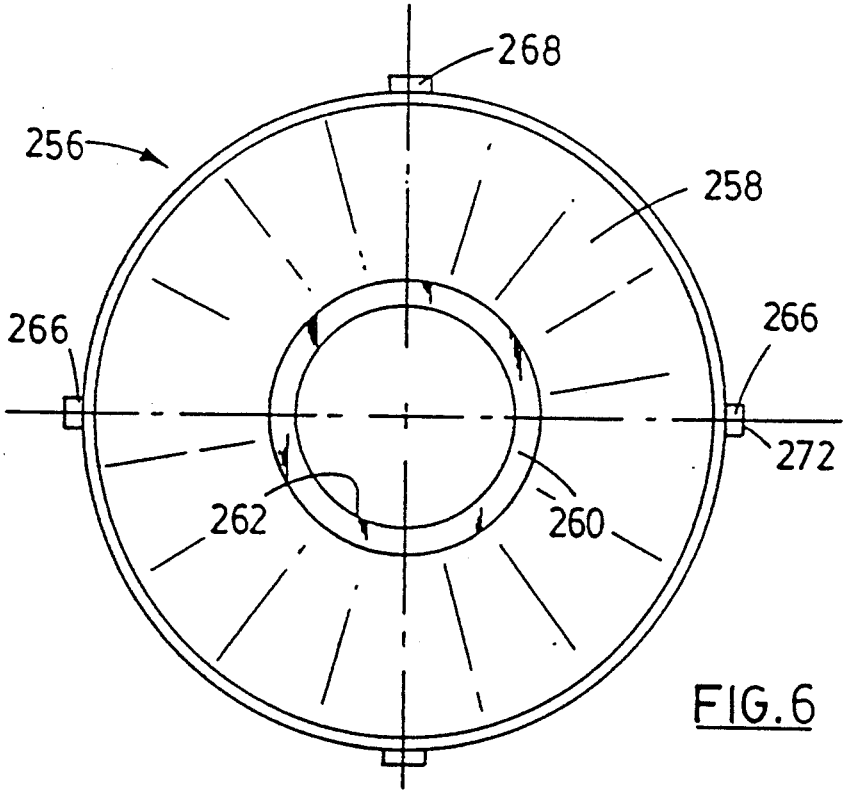

FIGS. 1, 5 and 6 illustrate a lower disc support member 256 which rests on the head 180. The member 256 includes upwardly and outwardly flaring frustoconical wall 258, which wall starts from a narrow lower annular flange 260. The flange has a central opening 262 through which the transfer tube 168 can pass.

Two pairs of diametrically opposed vanes 266, 268 are provided on the outer surface of the wall 258 so as to extend the height thereof, with a portion 270 of each projecting below the bottom surface of flange 260. As seen in FIG. 1, there is a small clearance between the outer edge 272 of each vane 266, 268 and the inner surface 276 of the lower bowl member 116.

With reference now to FIGS. 1 and 7 to 12, the remaining structural features of the invention of Ser. No. 579,008 will be described. In particular it will be seen from FIG. 1 that there is a plurality of separator discs 278, 280, 282 positioned between the lower and upper disc supports 256, 238. There is a single lowermost disc 278, a plurality of intermediate discs 280 and a single uppermost disc 282. The discs 278, 280, 282 are shown more completely in FIGS. 7 to 12.

Figure 7:
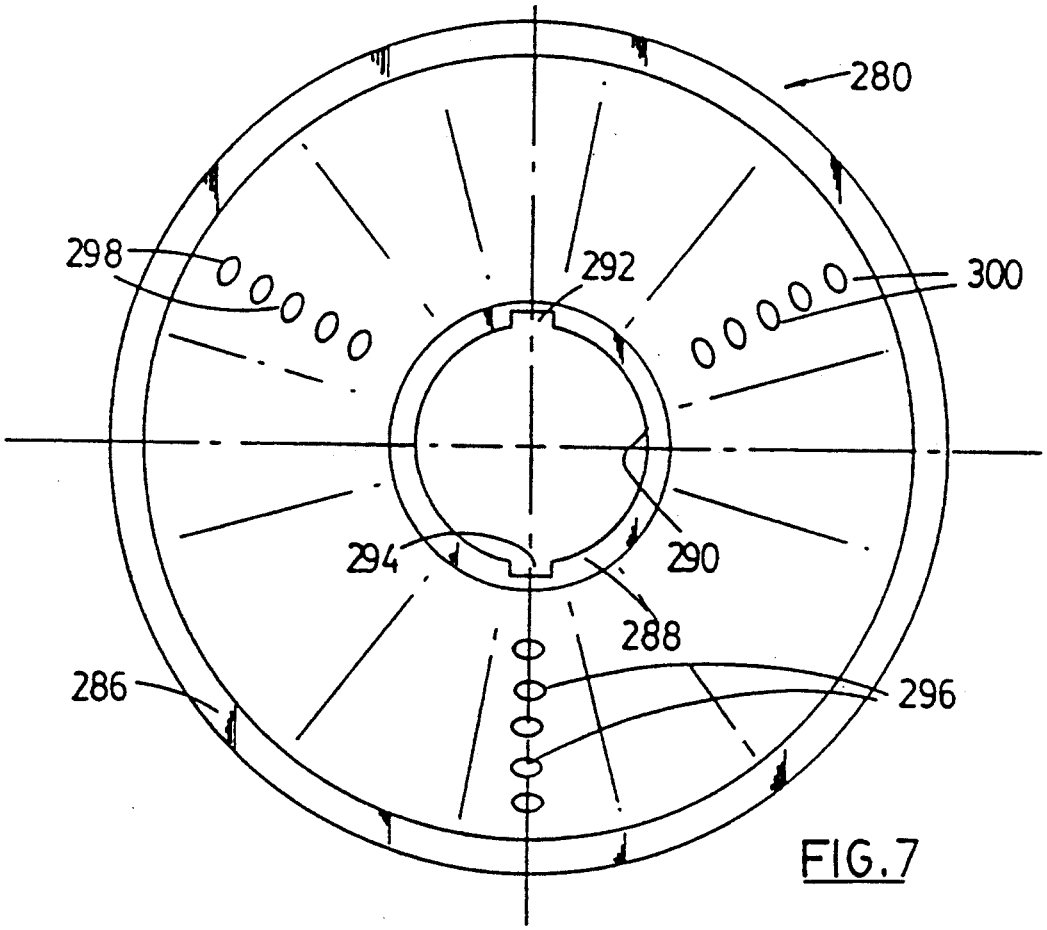
FIGS. 7 and 8 show a plan view and a longitudinal section of a disc member.
Figure 8:
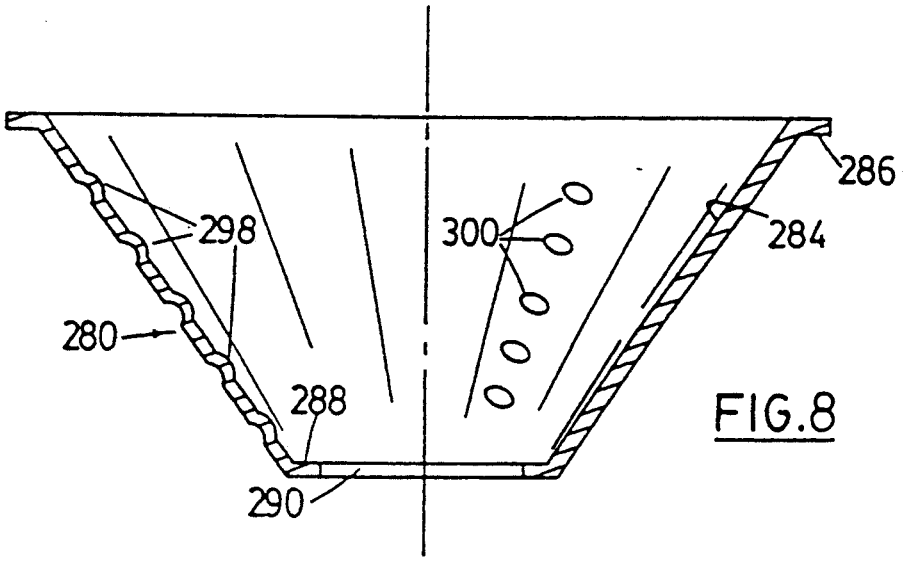

The separator discs 280 are best seen in FIGS. 7 and 8. Since the discs 280 are identical to each other, only one will be described, it being noted that the disc includes a frustoconical wall 284 with an outwardly projecting annular rim 286 at the upper, or largest diameter, end. At the lower, or small diameter end there is an inwardly directed annular flange 288 defining a central opening 290 and a pair of diametrically opposed slots or keyway 292, 294. The opening 290 is of a size to receive the transfer tube 168 and the keyways are alignable with the keyways 224, 226 in the tube 168.

The disc 280 may be formed from anodized aluminum and, radially aligned with one of the keyways 294, there is a linear series of generally hemispherical dimples 296 formed in the wall 284 so as to project into the interior of the disc. Two other radially aligned series of dimples 298, 300 project into the interior of the disc along lines offset from the line of dimples 296 by about 120°.

Figure 10:
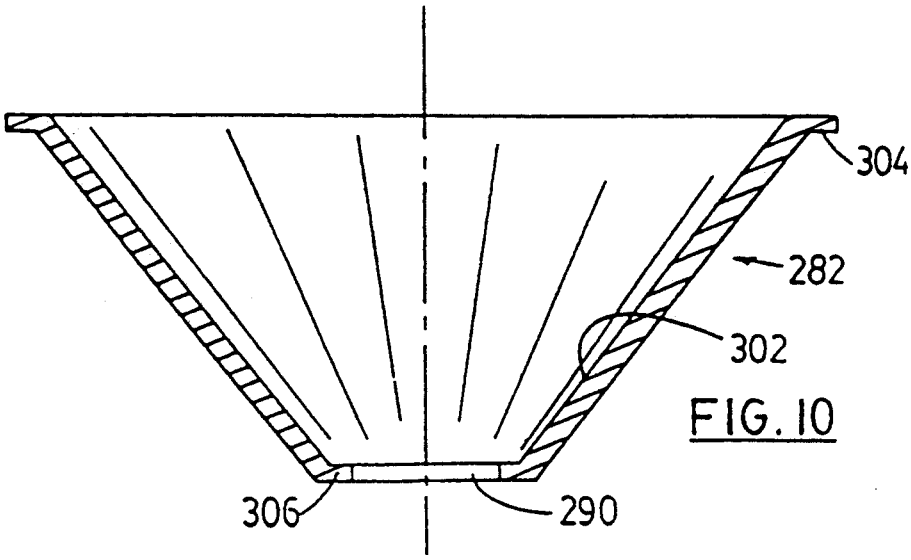
FIGS. 9 and 10 show a plan view and a longitudinal section of the upper disc member.
Figure 9:
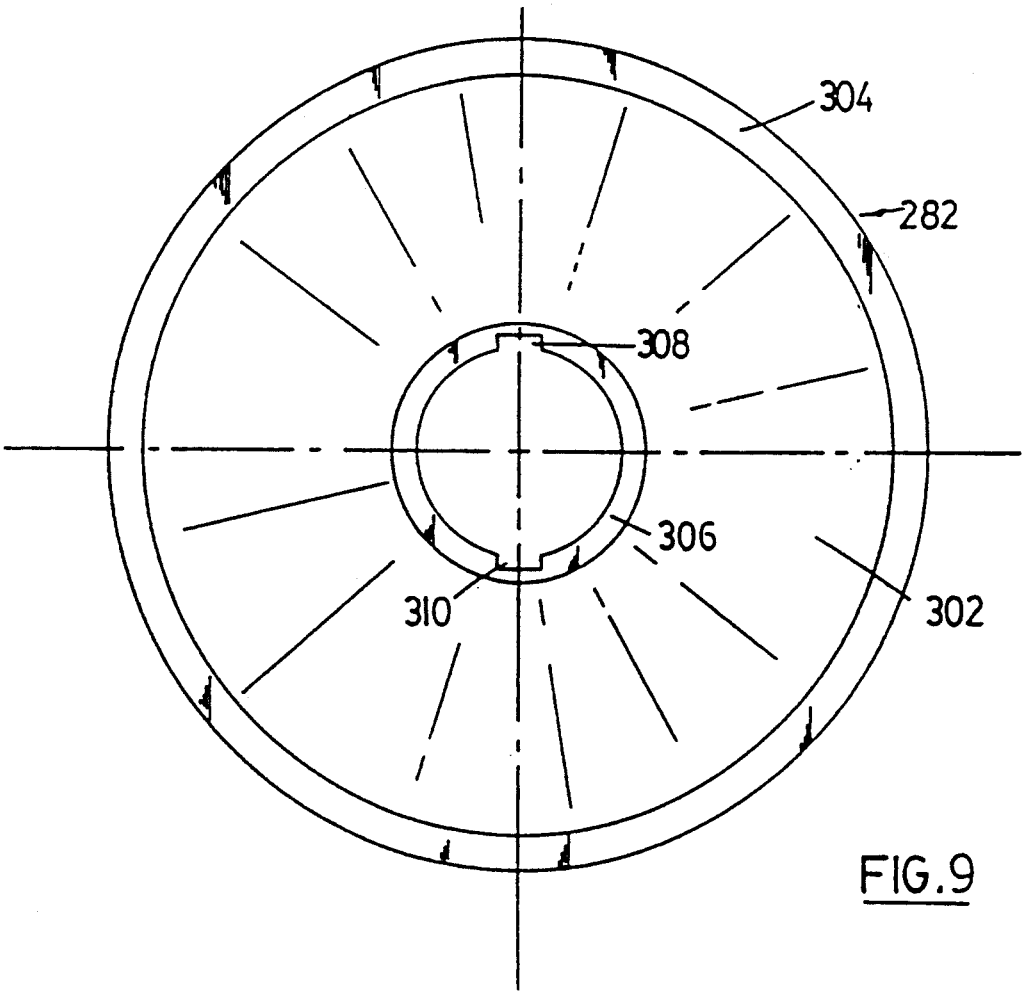

With reference to FIGS. 9 and 10, it will be seen that the upper disc 282 is essentially the same as the discs 280 except that it does not have any dimples therein. Thus, the frustoconical wall 302 of the disc 282 is smooth. The disc 282 has a rim 304, flange 306 and keyway slots 308, 310 which are analogous to the rim 286, flange 288 and keyway slots 292, 294 of the disc 280.

Figure 11:
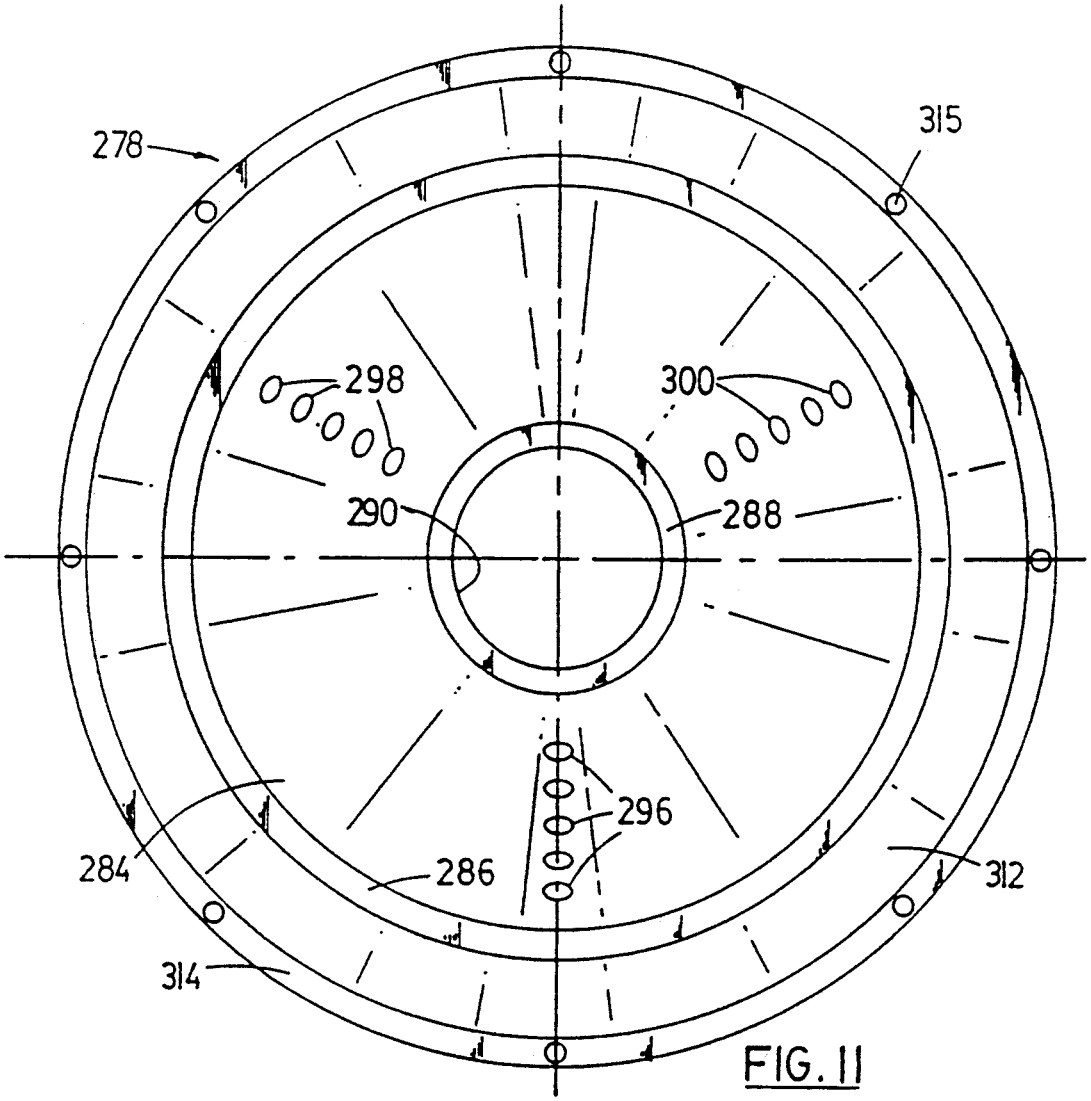
FIGS. 11 and 12 show a plan view and a longitudinal section of the lowermost disc member.
Figure 12:
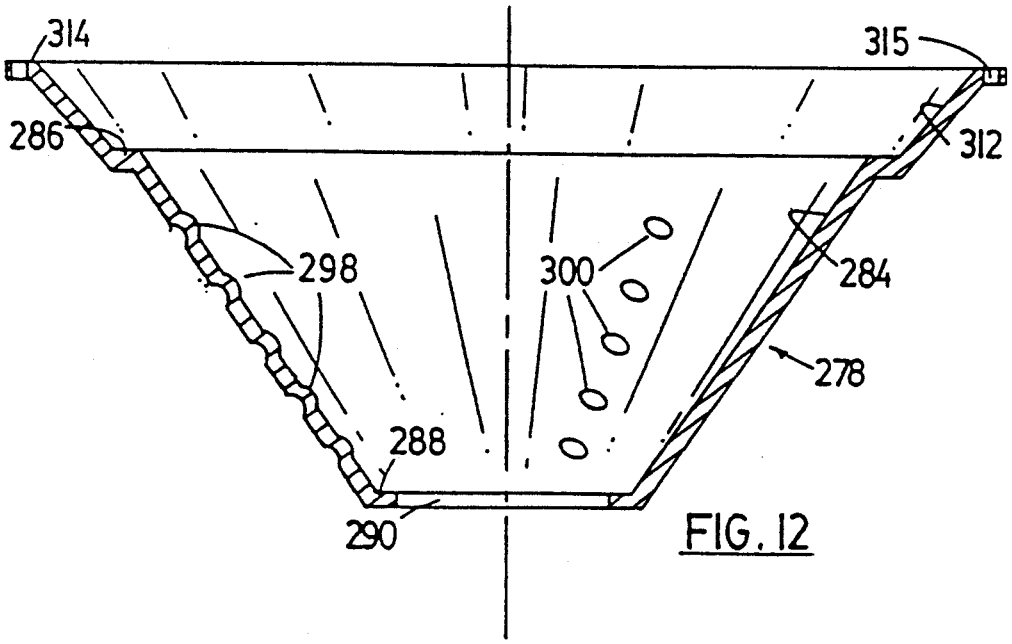

With reference to FIGS. 1, 11 and 12 it will be seen that the disc 278 is identical to the disc 280 except that it lacks keyways 292, 294 and it includes an upwardly and outwardly flaring wall portion 312 which extends upwardly from the outer edge of rim 286 and which has an outer rim 314 at the upper edge thereof. A plurality of circumferentially spaced circular feed ports or holes 315 may be provided through or near the outer rim 314 of the lowermost disc 278.

When assembling discs to achieve the configuration of FIG. 1, one first of all slides the lower disc support member 256 down over the tube 168 with the tube 168 passing through the opening 262 and the flange 260 resting on the lower head 180 of the tube 168. If desired, an O-ring may be placed in a recess 271 in the upper portion of the disc support 256, on which the flange 288 will rest, (see FIG. 5) so as to prevent air from being drawn into the pump from the transfer tube. Alternatively, the lowermost disc 278 could be bonded to the disc support or it could even be moulded integrally with the disc support itself and sealed to the transfer tube 168. One then, inserts a key 316 in keyway 224 of transfer tube 168 and the key 250 in the keyway 226 of the transfer tube 168.

With the lower disc support member 256 in place, the lower disc 278 is placed over the tube 168 until its wall 284 rests on the inner wall 258 of the support member 256.

From FIG. 1, it is seen that the included cone angle of the support member 256 and of the disc 278 is greater than the included cone angle of the lower bowl member 116 so that the inner wall of the bowl member approaches the wall 284 of the disc 278 in the vicinity of the rim 286. The inner wall of the bowl member is circumferentially recessed as at 318 to accept the rim 286 in close juxtaposition thereto, the upper wall portion 312 of the disc member 278 being located within the recessed wall area 318.

Thereafter, one places on the tube 168 the plurality of discs 280 to achieve a build-up of vertically spaced apart discs 280 (due to the dimples 296, 298, 300) above the disc 278, all of the discs 278, 280 being keyed to the transfer tube via keys 250, 316. In order to effectively utilize the dimples 296, 298, 300 to space the walls 284 of the discs 278, 280 apart, one should ensure that the keyway slot 294 of successive discs is only engaged with one of the keys 250, 316 so that the dimples of each disc coincide with the dimples of the adjacent discs. This reduces the impact of the dimples on separation.

After the topmost disc 280 is assembled to the tube 168, the upper disc 282 is placed over the tube 168 and keyed thereto by engagement of the keyway slots 308, 310 with the keys 250, 316. The upper disc 282 rests on the dimples 296, 298, 300 of the uppermost disc 280. Then the upper disc support member 238 is assembled onto the tube 168 with the keyway slot 248 therein engaging the upper end of key 250. The wave spring 254 is placed on the tube 168 to rest on the upper surface of the upper disc support member and the circlip 252 is placed in the groove to clamp the members therebelow into a unitary rotatable assembly, one with the transfer tube 168.

Finally, a short length of shaft 320 may be threaded onto the threaded shank 182 of the head 180, the shaft 320 having a conical end 322 projecting into the innermost cylinder or tube 134. This shaft 320 promotes acceleration of the fluid and prevents cavitation.

OPERATION OF THE ESTABLISHED STRUCTURE

With the decanting centrifuge of the invention of Ser. No. 579,008 in position and locked to the neck 14 of a container 12, one, first of all, connects a source of pressurized gas, such as air, carbon dioxide, etcetera, (not shown) to the gas inlet port 82 in a conventional manner. Preferably the connection will be valved to control the pressure introduced into the centrifuge.

With the pressurized gas entering the centrifuge via port 82, the motor 62 is started and is controlled to rotate at a relatively low speed, preferably under 1000 r.p.m. The motor causes shaft 66 to rotate and that shaft in turn causes transfer bushing 160, transfer shaft 162 and transfer tube 168 to rotate. Furthermore, the upper bowl member 140 will rotate through its pinned connection to the upper disc support member 238 which is keyed to the transfer tube 168. Also, as the tube 168 rotates so will the discs 278, 280, 282 and the lower shaft 320.

In view of friction between the mating surfaces 146, 148 of the upper and lower bowl members 140, 116 initial rotation of the upper bowl member 140 will cause rotation of the lower bowl member 116 as well.

As the centrifuge operates, pressurized gas will pass via inlet port 82 into the interior between the bowl members 116, 140 and the outer casing members 18, 44. The pressurized gas will pass between the lower bearing support 84 and the mounting member 24, past the vanes 88 and along the annular passageway 96 defined between the outer and intermediate cylindrical members 42, 92 to pressurize the container 12. Gas also flows between the upper rim of deflector plate 98 and the lower bowl member 116, through the bearing assemblies 104, 110 and between the intermediate and inner cylindrical members 92, 134 to help pressurize the container. Since the centrifuge seals the neck 14 of the container 12, the fluid therein is forced to rise along the inner cylindrical member 134 until it reaches the lower shaft 320 which, through its rotation, imparts additional rotary movement to the rising fluid. Since the lower bowl member 116 is rotating, the inner cylindrical member 134 will also be rotating and thus the rising fluid will be rotating at a progressively greater speed as it rises in the member 134.

When the rising fluid reaches the head 180, it will move upwardly and outwardly along the inner wall of the lower bowl member 116, past the vanes 266 and between the inner wall of the lower bowl member 116 and the lowermost disc 278. The fluid will eventually reach the open annular area between the bowl members 116, 140 and the rims of the discs 280 and 282. As fluid continues to flow upwardly into the area 324, it will be forced to flow downwardly along the disc members 278, 280 and the particulate matter within the fluid will be accumulating within the area 324 under centrifugal forces. Separated fluid, containing little or no particulate matter will flow inwardly and downwardly along and between the discs 278, 280, 282 and then pass through the slots 222 into the interior of the transfer tube 168.

Separated fluid within the transfer tube 168 will be forced upwardly through the cylindrical passage 236 of the sill 230. The sill creates a degree of back-pressure to ensure that separation of particulate matter will take place along all of the discs. Finally, the separated clean fluid will exit the openings 176 into the discharge chamber 76 and after sufficient fluid has accumulated therein, it will discharge through the outlet port 80 to be transferred to wherever the operator may desire.

As the fluid accumulates in the area 324 there will be sufficient upwards hydraulic pressure on the upper bowl member 140 to cause it to rise against the bias of wave spring 190 causing a small gap to appear between the mating surfaces 146, 148. Fluid containing a large proportion of particulate matter will exit the area 324 centrifugally between the surfaces 146, 148 and will fall downwardly along the essentially vertical inner wall of the outer housing member 20. This material is recycled to the container 12 under the influence of gravity. The separated material enters the container between the outer and intermediate cylindrical members 42 and 92.

Eventually, an equilibrium condition will be achieved with the fluid entering the centrifuge, separation occurring in the area 324, particulate matter exiting between the surfaces 146, 148 as the bowl members rotate and supernatant (separated fluid) exiting via the discharge port 80.

The maximum gap between the surfaces 146, 148 is adjustable by way of the adjusting nut 186 which defines a stop against which the upper bowl member 140 will abut when at its maximum open position. When it is necessary to alter the maximum opening between the surfaces 146, 148, the operator will stop the centrifuge and rotate lever arm 202 to bring projection 214 into contact with the adjusting nut 186. While applying a slight pressure to the lever arm the operator manually rotates the motor shaft 66 via adjustment wheel 203 until the projection locks in notch 196. The adjustment nut is now locked. By manually rotating the adjustment wheel 203, the gap between the bowl members may be opened or closed. To run the centrifuge, the lever arm 202 is swung to the solid line position of FIG. 2 and locked in this position by a recess in the housing wall 78. If the wheel 203 has a rim mark thereon and if the top of the motor is provided with degree markings (not shown), it is possible to gauge the extent of the gap.

The deflector 98 plays an important role in the invention of Ser. No. 579,008 in that it helps to separate the gas flow from the recycle flow, thereby reducing foaming of the fluid. It also prevents the recycle fluid from flooding the bearings 104, 110 and it minimizes fluid drag on the rotating cylinder member 134.

During start-up, there is some gas leakage between the bowl members because the seal therebetween will probably not be perfect. Such flow or leakage is negligible compared to the unimpeded gas flow directly into the container. This strong disparity in gas flows allows the centrifuge to be primed by gas pressure; once primed, it is not essential to maintain gas pressure other than to drive the light phase discharge through outlet 80. However, one would probably maintain gas pressure within the centrifuge to reduce fluid drag and to partially counterbalance hydraulic pressure in the bowl, thereby reducing load on the bearings.

If, as suggested previously, one or both of the cylinder members 42, 92 terminates just inside the container, it is likely that foaming of the fluid within the container by the gas could be reduced. If the intermediate cylinder 92 and the inner cylinder 134 are of approximately equal length, extending towards the bottom of the container, it would be desirable to include a fluted steady bearing or a spider set (not shown) between the members just above the flange 130 to maintain the desired annular separation between the members during operation.

The centrifuge of the prior invention is designed to operate at a relatively low speed, less than 1000 r.p.m., and this enables the cost of materials to be less than for high speed centrifuges. The bowl member, the housing and perhaps even the discs may be plastic (e.g. polycarbonate) since the stresses on the components will be small. Furthermore, low speeds permit the maintenance of constant, unrestricted recycle. By being able to utilize continuous recycle, there will be little or no cell compaction in the area 324 and the centrifugal separation process is much gentler on living material than high speed centrifuges.

By combining the centrifuge 10 with the container 12 it is possible to continuously remove the supernatant and to replace the feedstock without disturbing the culture, a particular advantage for the microbiologist who is working with a yeast culture.

MODE FOR CARRYING OUT THE INVENTION

Figure 13:
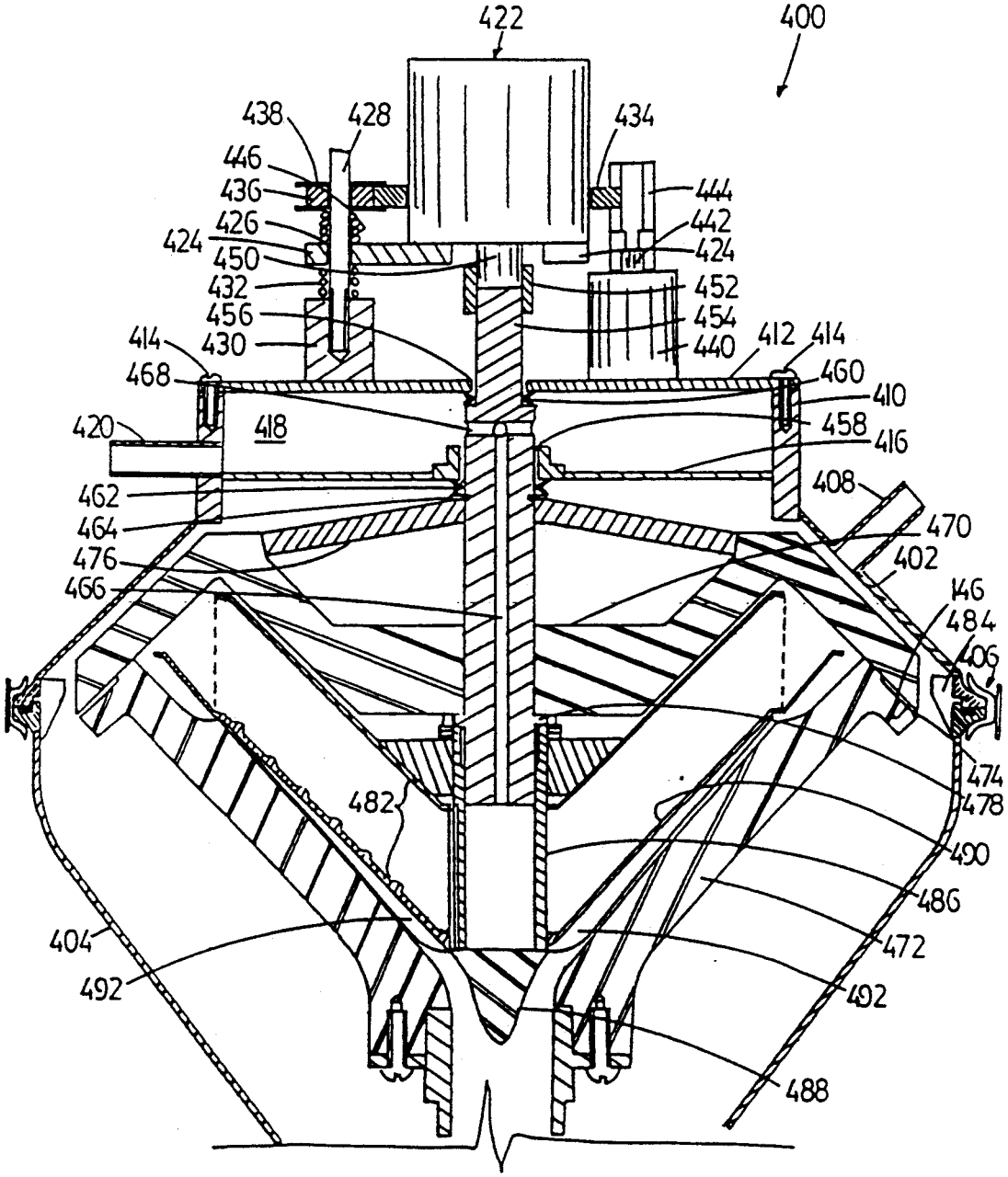
FIG. 13 shows a partial vertical cross-section through a portion of a decanting centrifuge incorporating certain improvements therein.

FIG. 13 illustrates a revised centrifuge configuration in which the upper bowl is rigidly secured to the transfer tube and the assembly thereof is raised or lowered as a single unit. In this embodiment the centrifuge is identified by reference number 400 and in FIG. 13 the lower portion thereof is not depicted, being essentially the same as shown in FIG. 1.

The embodiment of FIG. 13 includes an upper housing section 402 connected to a lower housing section 404 by a clamping mechanism 406 similar to that of the first embodiment. A gas inlet 408 is provided in the upper housing section. A cylindrical casing 410 is welded to the upper housing section and includes an upper mounting plate 412 attached to the casing by machine screws 414. An intermediate plate 416 defines a discharge chamber 418 with the casing and the mounting plate. A discharge outlet 420 communicates with the discharge chamber 418 through the casing 410.

The motor 422 has mounting means secured to the bottom thereof and extending radially therefrom. Preferably three mounting members 424, angled apart at 120° intervals, will be used. Each member has a vertically extending hole 426 passing therethrough for passage of a mounting screw 428 from above the member to a threaded boss 430 mounted on the mounting plate 412. A compression spring 432 is positioned between each boss 430 and the mounting member thereabove and surrounds the screw 428 which is threaded into the boss. Thus, the motor 422 and the equipment suspended therefrom will be resiliently supported on the springs 432.

A cylindrical sun gear 434 extends completely around the motor (see FIGS. 13 and 14) but is not affixed thereto. Three planetary gears 436 engage the sun gear 434, each gear 436 being threadedly supported on a respective screw 428 such that rotative movement of the gear 436 will move the gear upwardly or downwardly on the screw, depending on the direction of rotation. Plates 438 above and below the gear 436 extend radially outwardly so as to overly the sun gear 434 when the gear 436 is engaged with the sun gear to prevent unwanted disengagement between such gears. The same effect can be achieved by having similar plates on the sun gear which would overly the adjacent planetary gears.

A reversible, low speed, high torque motor 440 is secured to the mounting plate 412 with its shaft 442 extending vertically. An elongated pinion gear 444 is drivingly connected to shaft 442 and engages the sun gear 434 so that rotation of the pinion gear 444 by motor 440 will cause rotation of the sun gear 434. Such rotation also causes rotation of the planetary gears 436 causing, in turn, such gears to move up or down on the screws 428. Since the sun gear is constrained by the plates 438 the vertical movement of the planetary gears is translated back to the sun gear which will move vertically, up or down, by the same amount as the gears 434. The length of the pinion gear 444 is sufficient to prevent unwanted disengagement from the sun gear throughout the expected vertical travel of the sun gear 434.

A compression spring 446 surrounds each screw 428 and is located between the respective mounting member 424 and the underside of lower plate 438 secured to the planetary gear 436. Rotary movement of the sun gear 434, and hence vertical movement of the motor, alters the degree of spring compression. Such rotary movement can be monitored by a potentiometer gear 448 (FIG. 14) connected to suitable indicating means, not shown. The gear 448 could also be part of a feedback system used to automatically control operation of motor 440.

The shaft 450 of motor 422 is coupled, as by coupler 452 to the upper end of a cylindrical transfer shaft 454 which extends downwardly into the concentrator through opening 456 in mounting plate 412 and opening 458 in dividing plate 416. A gas seal 460 such as a V-ring seal surrounds the shaft 454 and abuts the underside of mounting plate 412 to seal the opening 456 while permitting some vertical movement of the shaft. Another gas seal 462 surrounds the shaft 454 and abuts the underside of dividing plate 416 to seal the opening 458. Seal 462 is held in place by a retainer ring or circlip 464.

An axially extending bore 466 is provided in shaft 454, extending from the bottom thereof to radially extending bores 468 located within the discharge chamber 418.

The interior of the particle concentrator of FIG. 13 is very similar to that shown in FIG. 1. Thus there are upper and lower bowl members 470, 472 respectively having essentially the same configuration as bowl members 140, 116. However, the rim surface of the lower bowl member has a cut back or stepped down portion 474 generally parallel to the rim of the upper bowl member to reduce the contact area with the annular surface 146 of the upper bowl member. Furthermore, the upper bowl member 470 may be braced against the transfer tube as by strut plate 476. The bowl member rests on an annular shoulder 478 of the transfer tube and the strut plate 476 is locked firmly in place against the bowl member by retaining ring or circlip 464. During bowl separation the upper bowl member 470 is able to move only from side to side, pivoting about the point of contact between the transfer tube 454 and the motor shaft 450.

It is apparent from FIG. 13 that the maximum gap between the upper and lower bowl members can be set by controlling the motor 440 to raise or lower the gears 436 and thereby affect the amount that the springs 446 can be compressed. When the concentrator is at rest the weight of the motor 422, the transfer tube 454, the upper bowl member 470 and the disc stack 482 plus the load on springs 446 is sufficient to compress the springs 432 so that the mating peripheral surface of the upper and lower bowl members are in contact. During operation, with the bowl members, disc stack and transfer tube rotating, there will be, eventually, sufficient pressure within the bowl members by the accumulating liquid suspension to force the upper bowl member upwardly so as to open the gap between the bowl members and thereby allow the particulate concentrate to discharge. Such upward movement is translated back through the transfer tube 454 to the motor 422 and the mounting members 424 which, in turn compress the springs 446 against the underside of the gears 436. Those springs are selected to have limited compression in relation to the compression of springs 432 and the operating pressure within the bowl members so that a balance of such forces is achieved at the desired maximum gap between the bowl members. That gap can be increased or decreased by moving the gears 436 upwardly or downwardly by the motor 440. As indicated previously the motor 440 can be controlled manually, by an operator, or automatically, by a computer programme with or without a feedback system.

Other improvements over the embodiment of FIG. 1 are also illustrated in FIG. 13. For example, a diverter ring 484 may be installed on the inner periphery of the housing sections 402, 404 to help direct the recycle stream downwardly. Also, the lower end of the transfer tube 454 may include a detachable portion 486 to which the disc stack 482 is affixed and which may be threadedly attached to the lower end of the transfer tube, making assembly and repair, if required, easier than before. The lower end 488 of the detachable portion 486 may be shaped more closely to the adjacent bowl wall to reduce the formation of air locks. Finally the lowermost disc member 490 of the stack 482 has the impeller vanes 492 (analogous to vanes 266) formed integrally therewith, as in a molding operation, again to simplify construction. Such vanes can extend over most of the length of the disc 490. The lower edges of the vanes will be closely adjacent the surface of the lower bowl member, or even located loosely in radial grooves of that surface so as to aid in imparting rotative motion to the lower bowl member.

Figure 16:
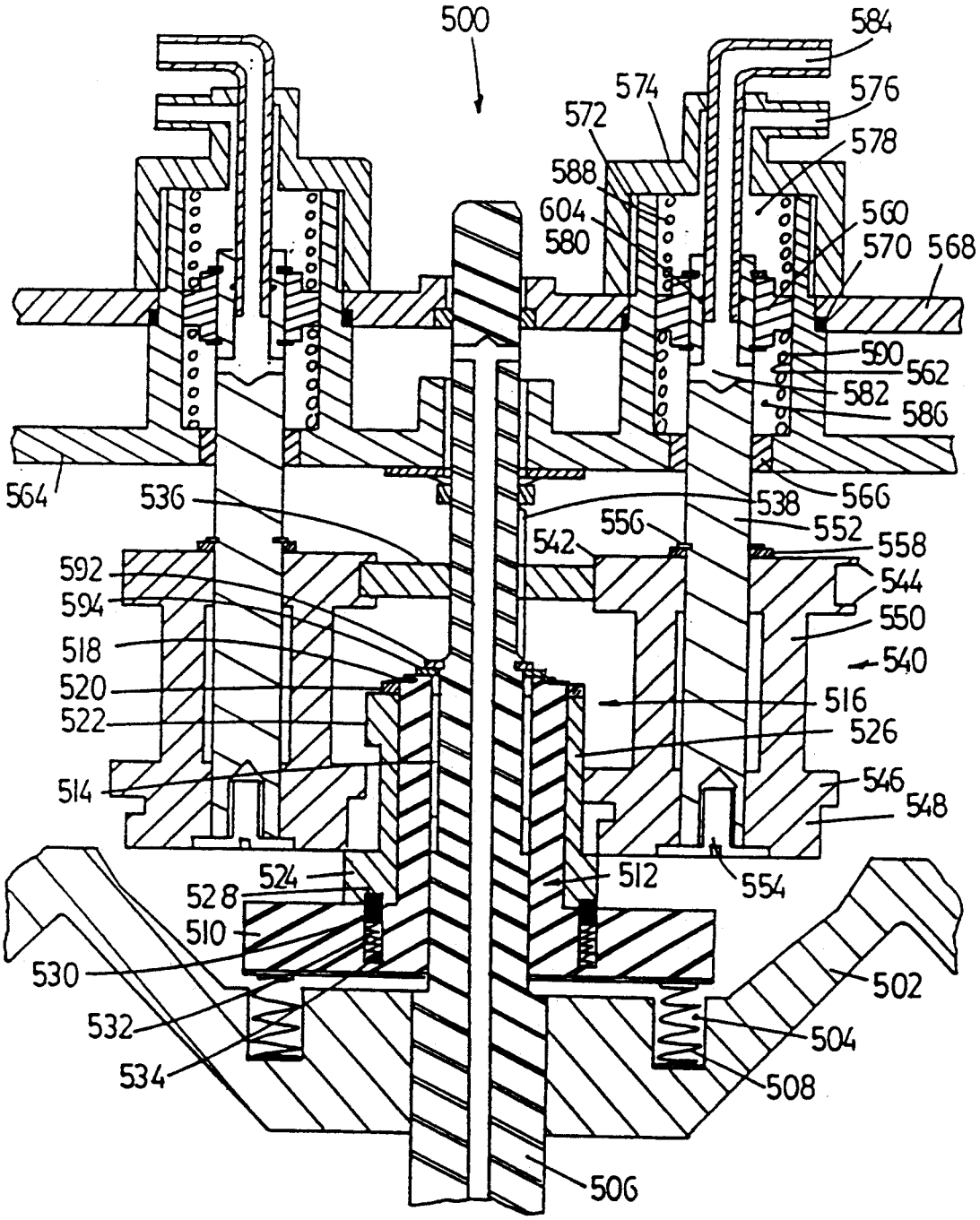
FIG. 16 shows a partial vertical cross-section of another adjusting mechanism for the centrifuge.

FIG. 16 illustrates another adjustment mechanism, the figure showing only a portion of the interior components since the remaining components may be as shown in FIG. 1 or in FIG. 13. In this instance the adjustment mechanism carries reference number 500.

The upper bowl member 502 has a plurality of circumferentially spaced, axially extending recesses 504 in the upper portion thereof, surrounding a transfer tube 506. Each recess contains a compression spring 508 which abuts the underside of an annular flange 510 at the base of adjusting nut 512. The nut 512 is threadedly mounted on the transfer tube 506 as by mating threads 514 and the axial position of the nut 512 on the tube will define or control the maximum gap available between the upper and lower bowl members.

A primary gear cluster or member 516 is fitted over the small diameter portion of the nut 512 and is secured thereto by way of a retaining ring 518 and washer 520. The gear member 516 includes an uppermost spur gear 522 identified as the lesser adjustment gear and a lowermost spur gear 524 identified as the greater adjustment gear. Between these gears is a connecting section 526 of least outside diameter. In the bottom of the gear 524 there is a plurality of closely circumferentially spaced recesses 528. Two or more ratchet pins 530 are each biased upwardly towards recesses 528 by a spring 532 held in a corresponding recess 534 in the upper portion of flange 510. Of course, the springs 532 and pins 530 could be contained in recesses 528 so as to be biased downwardly towards recesses 534. The significance of the ratchet pins will be explained hereinafter with respect to the operation of the adjustment mechanism.

A drive gear 536 is set on a spline 538 of the transfer tube 506 above the adjusting nut 512. Because of the splined interconnection between the transfer tube and the drive gear the drive gear will rotate in the same direction and at the same speed as the transfer tube 506 and it can also move axially on the transfer tube.

Two or more secondary gear clusters 540 engage the drive gear 536 and the adjustment gear 516. Only one of the gear clusters 540 will be described herein.

Each gear cluster 540 has an uppermost or transfer drive gear 542 which includes a pair of shoulders 544 embracing the drive gear 536 so that vertical travel of the gear 542 will induce the same amount of vertical travel of the drive gear 536 along the spline 538. The drive and transfer drive gears are always in engagement such that rotation of the transfer tube induces rotation of the secondary gear clusters 540 through the drive and transfer drive gears. Shoulders 544 could, of course, be provided on the drive gear so as to overly a portion of each transfer drive gear 542.

At the bottom of the secondary gear cluster are two lower gears 546, 548, connected to the transfer drive gear by an intermediate section 550. The gear 546 is identified as the greater transfer gear, having a greater pitch diameter than the gear 542, and the gear 548 is identified as the lesser transfer gear, having a smaller pitch diameter than the transfer drive gear. The gear cluster 540 is freely rotatably mounted on a transfer shaft 552 which extends downwardly from the upper housing wall, parallel to the transfer tube 506. The secondary gear cluster 540 is retained on the transfer shaft by lower retaining screw 554 and upper retaining ring 556 and washer 558 such that vertical displacement of the shaft 552 induces the same amount of vertical displacement of the gear cluster 540.

Vertical travel of the secondary gear clusters 540 can be effected in any number of conventional ways. Inasmuch as gas pressure is used to operate the centrifuge it is convenient to use available gas pressure to move the gear clusters vertically. To that end a piston member 560 is retained on the transfer shaft 552 within a piston chamber 562 formed on the divider plate 564 (analogous to plate 74 of FIG. 1 or plate 416 of FIG. 13). The transfer shaft is sealed relative to the plate 564 where it passes therethrough by annular seal means 566.

The wall of chamber 562 passes through the upper wall 568 and is sealed thereto by an annular seal member 570. The wall is threaded as at 572 and receives a threaded cap 574 which defines the upper limit of chamber 562. An inlet opening 576 provides access for gas under pressure to the upper portion 578 of chamber 562.

The upper end of transfer shaft 552 has an axial bore 580 therein which communicates with radial bore 582. An inlet insert 584 passes through cap member 574 and is received in bore 580 so as to pass gas under pressure into lower portion 586 of chamber 562. Helical compression springs 588 and 590 are provided within chamber portions 578 and 586 respectively and bear against piston 560 so as to locate the piston 560 and hence the shaft 552 and attached gear cluster 540 at a predetermined desired vertical neutral position relative to the gear 516.

Vertical adjustment of the adjustment nut 512 is achieved by causing rotation of the adjustment nut 512 on the shaft 506 through appropriate rotation of the gear 516. The gear 516 transfers its rotation to the nut 512 through the ratchet pins 530, which are part of a bi-directional overrunning clutch mechanism.

It should be understood that when there is no engagement between the gear clusters 540 and the gear 516 the gear clusters 540 are at the neutral position shown in FIG. 16 and that the gear 536, the gear clusters 540, the adjustment nut 512 and the gear 516 are all rotating at a fixed speed through rotation of the transfer tube 506, powered by the drive motor (not shown). Assuming a right-hand thread 514 between the transfer tube 506 and the adjustment nut 512 and clockwise rotation of the transfer tube, movement of the nut downwardly is achieved by having it rotate slightly faster than the transfer tube and movement upwardly is achieved by having it rotate slightly slower than the transfer tube. This is accomplished through the gears previously mentioned and as described below.

If pressurized gas is introduced into the inlet 584 such gas will enter chamber 587 via outlets 582 and provide an upwardly directed forced on the piston 560 against the bias of springs 588. The piston raises the shaft 552 and the secondary gear cluster 540 to bring the greater transfer gear 546 into engagement with the lesser adjustment gear 522 thereby causing rotation of the gear 516 at a speed determined by the pitch diameters of the gears. Rotation of the gear 516 causes rotation of the adjustment nut 512 via the pins 530 engaging in the recesses 528. With appropriate rotation such rotation of the adjusting nut will be at a greater speed than that of the transfer tube and the adjusting nut will move down the transfer tube increasing the compression on the springs 508 and thereby reducing the maximum gap available between the upper and lower bowl members. The present invention comtemplates that downward movement of the adjusting nut 512 by about 3 mm will increase the compression in the springs 508 enough to stop rotation of the adjusting nut 512. This is possible by designing the recesses 528, the pins 530 and the springs 508 and 532 so that at a desired or predetermined resistance to rotation the gear 516 will overrun the drive pins 530 in the manner of a ratchet. This leaves room for disengagement of the gears 546, 522 when the secondary gear cluster 540 is returned to its rest position as shown in FIG. 16.

To effect downward movement of the gear cluster 540 pressurized gas is introduced into upper chamber 578 via inlet 576 to move piston 560 downwardly against bias spring 590. Such movement brings the lesser transfer gear 548 into engagement with the greater adjustment gear 524 and causes the adjustment gear 516 to rotate at a speed less than that of the transfer tube. Rotation of the adjustment nut is retarded through engagement of the pins 530 and consequently the nut will travel upwardly on the transfer tube 506. The maximum upward movement of the nut 512 is determined by the retaining ring 592 positioned on the transfer tube 506. When washer 594 on the adjusting nut 512 encounters the retaining ring 592 the adjusting nut will stop but the gear 516 can continue to rotate by overrunning the drive pins 530 described previously. By reducing the degree of compression of the springs 508 the maximum available gap between the upper and lower bowl members is increased.

While the adjusting nut 516 is travelling vertically the secondary gear clusters remain vertically stationary. When the desired movement of the adjusting nut has been achieved the secondary gear clusters are returned to the neutral position, disengaging the relevant gears and permitting the adjustment nut to rotate at the same speed as the transfer tube 506. To facilitate engagement between the transfer gears 546, 548 and the adjustment gears 522, 524 the gear teeth on both sets of gears are bevelled radially on the engaging faces as shown in FIG. 15. Thus in that figure the lower edge 596 of the lesser adjustment gear 522 and the upper edge 598 of the greater transfer gear 546 are bevelled so that as the gears come together with the secondary gear cluster moving upwardly there will be sliding contact between the faces 596, 598 which promotes engagement of the gears. Similarly the respective mating faces 600, 602 of the lesser transfer gear 548 and the greater adjustment gear 524 are bevelled to promote engagement of the gears as the secondary gear cluster moves downwardly.

The inlet tube 584 may be held stationary within the cap 574 so that the shaft 552 can slide vertically relative thereto. In that case an O-ring seal 604 would be provided to seal the inlet tube 584 with respect to the shaft 522.

The adjustment mechanism as described provides a support for the transfer tube 506 through the continuous engagement of the drive gear 536 with the transfer gears 542 of the secondary gear clusters 540. A minimum of two secondary gear clusters is required to counterbalance the lateral forces on the transfer tube during gap adjustment but three or more secondary gear clusters may be preferred to secure the transfer tube against lateral movement. This would also help to isolate the disc stack from vibration and would be particularly helpful in circumstances requiring an unusually large bowl gap, as when working with suspensions containing very coarse material.

Since the gap adjustment system of FIG. 16 is independent of the drive motor it is not absolutely necessary for the transfer tube to penetrate the upper housing plate 568, although it is shown as penetrating in FIG. 16. The upper end of the transfer tube could be set in a thrust bearing on the underside of plate 568 and rotated through a magnetic coupling by an external motor. That configuration would eliminate the risk of leakage or contamination through the upper housing plate.

As with the previous embodiment the gap adjustment mechanism just described can be controlled manually by an operator working to a predetermined programme of gap adjustments or in response to observed parameters. It could also be controlled by computer, so as to follow a preprogrammed set of gap adjustments, or in response to appropriately sensed pressure or flow conditions.

Although only two gap adjustment mechanisms have been shown herein it is understood that variations thereof could be effected by skilled workmen in the art without departing from the spirit of the present invention. Thus, the protection to be afforded this invention is to be determined by the scope of the claims appended hereto.

The embodiments of the invention in which an exclusive property or privilege is claimed are defined as follows:

1. In a centrifugal particle concentrator having: a housing mountable on a container; upper and lower rotatable bowl members within the housing, the upper bowl member being vertically movable relative to the lower bowl member; rotatable separator means within the bowl members; and a transfer tube extending axially of said concentrator, mounting said upper bowl member and said separator means at one end thereof and being drivingly connected to a drive motor at the other end, said transfer tube having a bore extending longitudinally thereof and communicating said separator means with a discharge chamber of said housing; the improvement in means for adjustably establishing a maximum available gap between said bowl members during operation of said concentrator, comprising:

an annular sun gear extending circumferentially about said drive motor;

a plurality of planetary gears engaging said sun gear and spaced circumferentially thereabout, each planetary gear being threadedly engaged with a non-rotatable mounting screw extending parallel to said transfer tube and being anchored in a boss affixed to said housing;

mounting means secured to said drive motor and extending radially outwardly therefrom, said mounting means being slidably receivable on each mounting screw between the respective planetary gear and boss, there being a first compression spring on each screw between the mounting means and planetary gear and a second compression spring on each screw between the mounting means and boss; and an adjustment motor on said housing, drivingly connected to an adjustment gear engaging said sun gear;

whereby rotation of said adjustment gear will cause rotation of said sun gear and consequent rotation of said planetary gears, such rotation of said planetary gears causing movement of each planetary gear along its mounting screw to further compress or to relax said compression springs and thereby control the amount of vertical movement available to said drive motor, transfer tube, separator means and upper bowl member relative to said lower bowl member.

2. The improvement of claim 1 including an upper plate and a lower plate on each planetary gear overlying a portion of said sun gear or on said sun gear overlying a portion of each planetary gear so as to constrain said sun gear to move with said planetary gears as each moves along its respective mounting screw.

3. The improvement of claim 2 wherein said adjustment gear is engageable with said sun gear throughout the entire range of movement of said sun gear.

4. The improvement of claim 3 wherein said mounting means comprises a plurality of circumferentially spaced individual mounting members extending radially from said drive motor to a corresponding mounting screw.

5. The improvement of claim 1, 2 or 3 including means bracing said upper bowl member to said transfer tube.

6. The improvement of claim 1, 2 or 3 wherein said housing comprises upper and lower housing sections releasably joined together about mating circumferential rim portions thereof, there being a diverter ring within said housing adjacent said rim portions to deflect a recycle stream of material back towards the container.

7. In a centrifugal particle concentrator having: a housing mountable on a container; upper and lower rotatable bowl members within the housing, the upper bowl member being vertically movable relative to the lower bowl member; rotatable separtor means within the bowl members; and a transfer tube extending axially of said concentrator, slidably mounting said upper bowl driving connected to a drive motor at the other end, said transfer tube having a bore extending longitudinally thereof and communicating said separator means with a discharge chamber of said housing; the improvement in means for adjustably establisihing a maximum available gap between said bowl members during operation of said concentrator, comprising:

an adjusting nut threadedly mounted on said transfer tube above said upper bowl member, with a plurality of circumferentially spaced compression springs between said upper bowl member and said adjusting nut;

a primary gear cluster rotatably mounted on said adjusting nut, said gear cluster including a greater adjusting gear thereon spaced therealong from a lesser adjusting gear thereon;

bi-directional overrunning clutch means drivingly connecting said primary gear cluster to said adjusting nut;

a plurality of secondary gear clusters spaced circumferentially about said transfer tube, each secondary gear cluster including a transfer drive gear at one end thereof, spaced therealong from a lesser transfer gear and an adjacent greater transfer gear;

a drive gear slidably and drivingly mounted on said transfer tube drivingly engaging each transfer drive gear;

a transfer shaft for each secondary gear cluster, extending parallel to said transfer tube and rotatably mounting the respective secondary gear cluster thereon; and means for raising and lowering said transfer shafts in synchronism;

whereby, as said transfer tube rotates said drive gear will cause each said secondary gear cluster to rotate on its transfer shaft, vertical movement of said transfer shafts from a neutral position thereof bringing either the greater or lesser transfer gears of said secondary gear clusters into driving engagement with the lesser or greater adjustment gear respectively of said primary gear cluster to either increase or decrease the rotational speed of said adjusting nut relative to said transfer tube so as to cause said adjusting nut to advance or retreat along said transfer tube and thereby increase or decrease the degree of compression in said springs to control the maximum available gap between said bowl members.

8. The improvement of claim 7 wherein said overrunning clutch means comprises a plurality of circumferentially spaced first recesses in a radial flange of said adjusting nut, a plurality of circumferentially spaced second recesses in a face of said primary gear cluster adjacent said flange and pin means in at least two of said first or second recesses spring biased into an adjacent second or first recess, respectively, said pin means causing said primary gear cluster to rotate with said adjusting nut when the secondary gear clusters are at the neutral position thereof, and permintting said primary gear cluster to overrun said adjusting nut when said adjusting nut has reached either limit of its available movement along said transfer tube.

9. The improvement of claim 8 wherein each transfer drive gear includes upper and lower shoulder means overlying a portion of said drive gear so as to constrain said drive gear to move along said transfer tube as each secondary gear cluster moves with its transfer shaft.

10. The improvement of claim 8 wherein said drive gear includes upper and lower shoulder means overlying a portion of each transfer drive gear so as to constrain said drive gear to move along said transfer tube as each secondary gear cluster moves with its transfer shaft.

11. The improvement of claim 9 or 10 wherein there is a splined connection between said drive gear and said transfer tube.

12. The improvement of claim 8 wherein each tooth of said greater and lesser adjustment gears and each tooth of said lesser and greater transfer gears has a bevelled radial face to facilitate engagement between the gears as said primary and secondary gear clusters rotate.

13. The improvement of claim 12 wherein each transfer shaft sealingly enters a pressure chamber in said housing and carries a piston member dividing said chamber into upper and lower chamber portions, there being inlet means for selectively introducing pressurized fluid into either said upper or said lower chamber portion to act on said piston member and thereby move said transfer shaft in a desired direction.

14. The improvement of claim 13 including compression spring means in said chamber portions biassing said piston member towards a rest position corresponding to the neutral position of the attached secondary gear cluster.

15. The improvement of claim 14 wherein the inlet means for said lower chamber portion includes a non-reciprocable hollow inlet tube extending through said upper chamber portion to be slidably received in an axial bore of the transfer shaft, said axial bore communicating with a radial bore which in turn communicates with said lower chamber portion.

16. The improvement of claim 1 or 7 wherein said lower bowl member has a peripheral rim surface with a stepped down portion therein to reduce the area of contact between the upper and lower bowl members.

* * * * *